US007719189B2

(12) United States Patent
Bae

(10) Patent No.: US 7,719,189 B2
(45) Date of Patent: May 18, 2010

(54) PLASMA DISPLAY PANEL

(75) Inventor: Jongwoon Bae, Gumi-si (KR)

(73) Assignee: LG Electronics Inc., Seoul (KR)

( * ) Notice: Subject to any disclaimer, the term of this patent is extended or adjusted under 35 U.S.C. 154(b) by 564 days.

(21) Appl. No.: 11/669,294

(22) Filed: Jan. 31, 2007

(65) Prior Publication Data

US 2008/0088222 A1 Apr. 17, 2008

(30) Foreign Application Priority Data

Oct. 16, 2006 (KR) ..... 10-2006-0100544

(51) Int. Cl.

| | |
|---|---|
| ***H01J 17/49*** | (2006.01) |
| ***H01J 1/62*** | (2006.01) |
| ***H01J 63/04*** | (2006.01) |
| ***H01J 9/00*** | (2006.01) |

(52) U.S. Cl. ..... 313/582; 313/485; 445/24

(58) Field of Classification Search ..... 313/485, 313/582–587; 445/24

See application file for complete search history.

(56) References Cited

U.S. PATENT DOCUMENTS

| | | | | |
|---|---|---|---|---|
| 2001/0004250 | A1 * | 6/2001 | Kado et al. | 345/60 |
| 2003/0146701 | A1 | 8/2003 | Kawamura et al. | |
| 2004/0056596 | A1 * | 3/2004 | Iguchi et al. | 313/582 |
| 2005/0017637 | A1 | 1/2005 | Kang | |
| 2005/0104519 | A1 * | 5/2005 | Jeon | 313/582 |
| 2006/0202619 | A1 | 9/2006 | Kim | |

FOREIGN PATENT DOCUMENTS

| | | |
|---|---|---|
| EP | 1058284 | 12/2000 |
| JP | 10-269949 | 10/1998 |
| JP | 11327498 | 11/1999 |
| JP | 2001-229835 | 8/2001 |
| KR | 2000-0011027 | 6/2000 |
| KR | 2005-0017637 | 2/2005 |

OTHER PUBLICATIONS

KR 2000-0011027 to Kwon et al. Translation provided.*
JP 2006-004670 to Masamichi. Translation provided.*
Chinese Office Action dated Nov. 13, 2009 for Application No. 200710002783.7, 8 pages (English translation).
Extended European Search Report dated Dec. 2, 2009 for Application No. 07001875.9, 6 pages.

* cited by examiner

*Primary Examiner*—Toan Ton
*Assistant Examiner*—Zachary Snyder
(74) *Attorney, Agent, or Firm*—Fish & Richardson P.C.

(57) ABSTRACT

A plasma display panel is provided. The plasma display panel includes a substrate and a phosphor layer. The phosphor layer has a red phosphor layer, a green phosphor layer and a blue phosphor layer. At least one of a start point of the red phosphor layer, a start point of the green phosphor layer and a start point of the blue phosphor layer is different from a start point of the remaining phosphor layer.

20 Claims, 14 Drawing Sheets

PLASMA DISPLAY PANEL

This Nonprovisional application claims priority under 35 U.S.C. §119(a) on Patent Application No. 10-2006-0100544 filed in Korea on Oct. 16, 2006 the entire contents of which are hereby incorporated by reference.

BACKGROUND

1. Field

The present invention relates to a plasma display panel.

2. Background of the Related Art

A plasma display panel has a phosphor layer positioned inside discharge cells partitioned by barrier ribs and a plurality of electrodes applied a driving pulse such that it is emitted light inside the discharge cells.

The driving pulse applied to the plurality of electrodes generates vacuum ultraviolet rays inside the discharge cells and the vacuum ultraviolet rays display an image on the screen of the plasma display panel.

SUMMARY OF THE DISCLOSURE

In one aspect, a plasma display panel includes a substrate and a phosphor layer having a red phosphor layer, a green phosphor layer and a blue phosphor layer. At least one of a start point of the red phosphor layer, a start point of the green phosphor layer and a start point of the blue phosphor layer is different from a start point of the remaining phosphor layer.

In another aspect, a plasma display panel includes a substrate and a phosphor layer having a red phosphor layer, a green phosphor layer and a blue phosphor layer. At least one of a length of the green phosphor layer and a length of the blue phosphor layer is more than a length of the red phosphor layer in a dummy area of the substrate.

In still another aspect, a plasma display panel includes a substrate, a plurality of barrier ribs and a phosphor layer having a red phosphor layer, a green phosphor layer and a blue phosphor layer. At least one of distances between an edge of the barrier rib and each edge of the red phosphor layer, green phosphor layer and a blue phosphor layer is different from a distance between an edge of the barrier rib and an edge of the remaining phosphor layer.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

A plasma display panel of the present invention will be described below with reference to the accompanying drawings.

Figure 1:
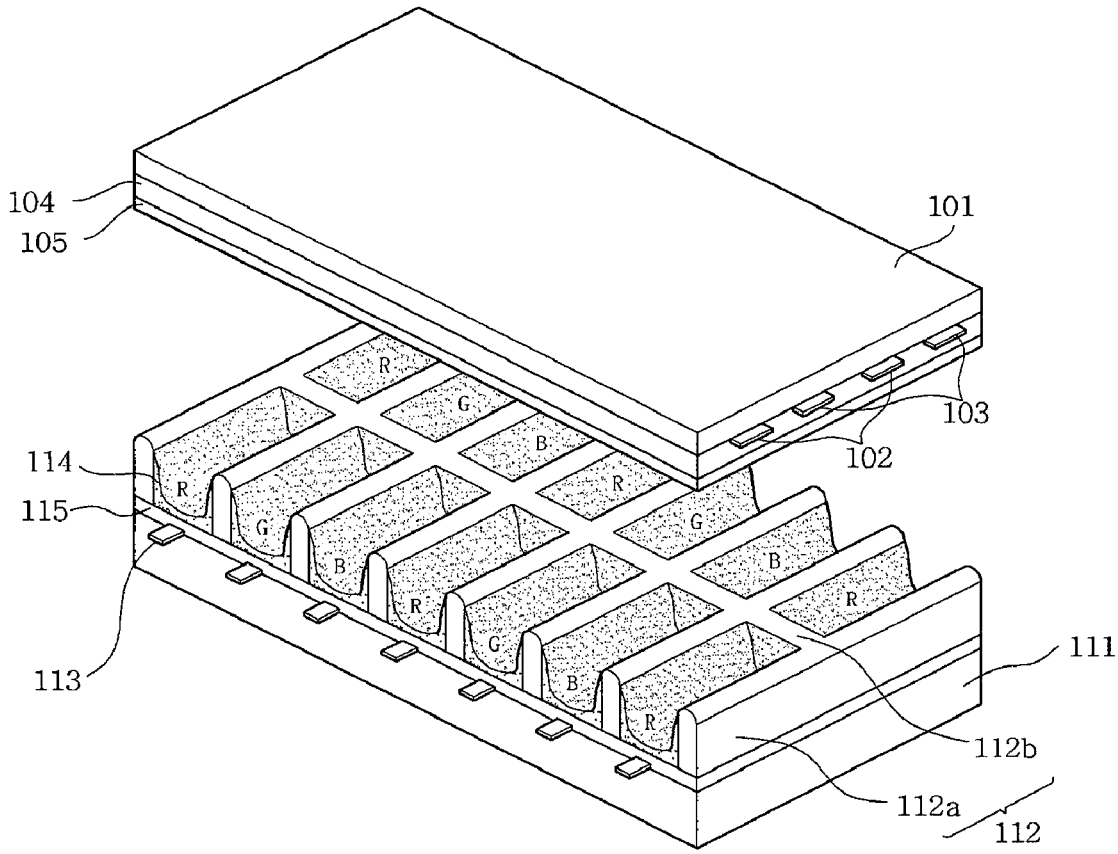
FIG. 1 illustrates the structure of a plasma display panel according to one embodiment.

FIG. 1 illustrates the structure of a plasma display panel according to one embodiment.

Referring to FIG. 1, a plasma display panel includes a front substrate 101 and a rear substrate 111 which are coalesced with each other. On the front substrate 101, a first electrode 102 and a second electrode 103 are formed in parallel to each other. On the rear substrate 111, a third electrode 113 is formed to intersect the first electrode 102 and the second electrode 103.

The upper dielectric layer 104 for covering the first electrode 102 and the second electrode 103 is formed on an upper portion of the front substrate 101 on which the first electrode 102 and the second electrode 103 are formed.

The upper dielectric layer 104 limits discharge currents of the first electrode 102 and the second electrode 103, and the upper dielectric layer 104 provides insulation between the first electrode 102 and the second electrode 103.

A protective layer 105 is formed on an upper surface of the upper dielectric layer 104 to facilitate discharge conditions. The protective layer 105 may be formed by deposing a material such as magnesium oxide (MgO) on an upper portion of the upper dielectric layer 104.

A lower dielectric layer 115 for covering the third electrode 113 is formed on an upper portion of the rear substrate 111 on which the third electrode 113 is formed. The lower dielectric layer 115 provides insulation of the third electrode 113.

Barrier ribs 112 are formed on an upper portion of the lower dielectric layer 115 to partition discharge cells.

A phosphor (i.e., red phosphor, green phosphor, blue phosphor) is formed inside the discharge cells to display colors.

In addition to the red (R), green (G), and blue (B) phosphors, a white (W) phosphor or a yellow (Y) phosphor may be further formed inside the discharge cells.

A structure of discharge cells in which is formed by barrier ribs may be a various type such as stripe type, a well type, a delta type, a honey type.

Both widths (a), (b), (c) of the red (R), green (G), and blue (B) discharge cells may be substantially equal to one another and each of the width of discharge cells may be controlled so as to improve a user's visibility when it is displayed an image on the screen of a plasma display panel.

Figure 2:
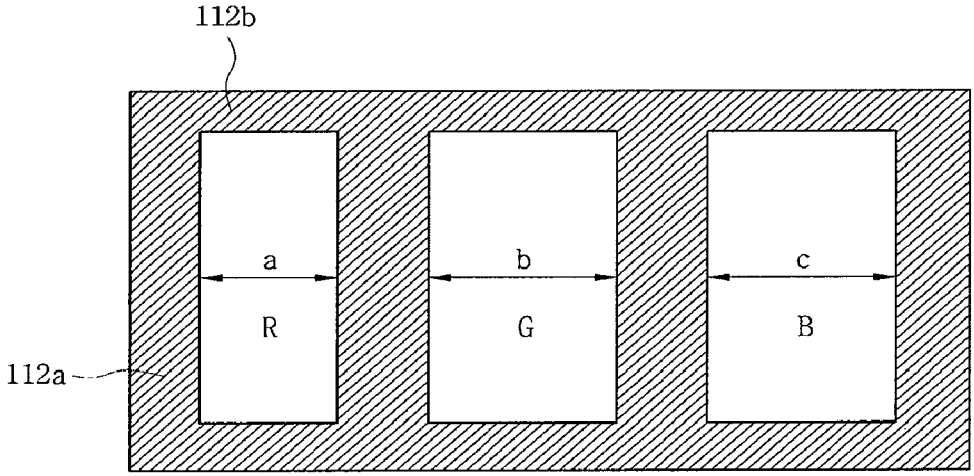
FIG. 2 illustrates the structure of a discharge cell according to one embodiment

In this case, as illustrated in FIG. 2, the widths of all of the red (R), green (G), and blue (B) discharge cells may be different from one another, or alternatively, the width of two discharge cells of the red (R), green (G), and blue (B) discharge cells may be different from the width of the remaining one discharge cell.

The plasma display panel according to one embodiment may have various forms of barrier rib structures as well as a structure of the barrier rib 112 illustrated in FIG. 1.

Figure 3A:
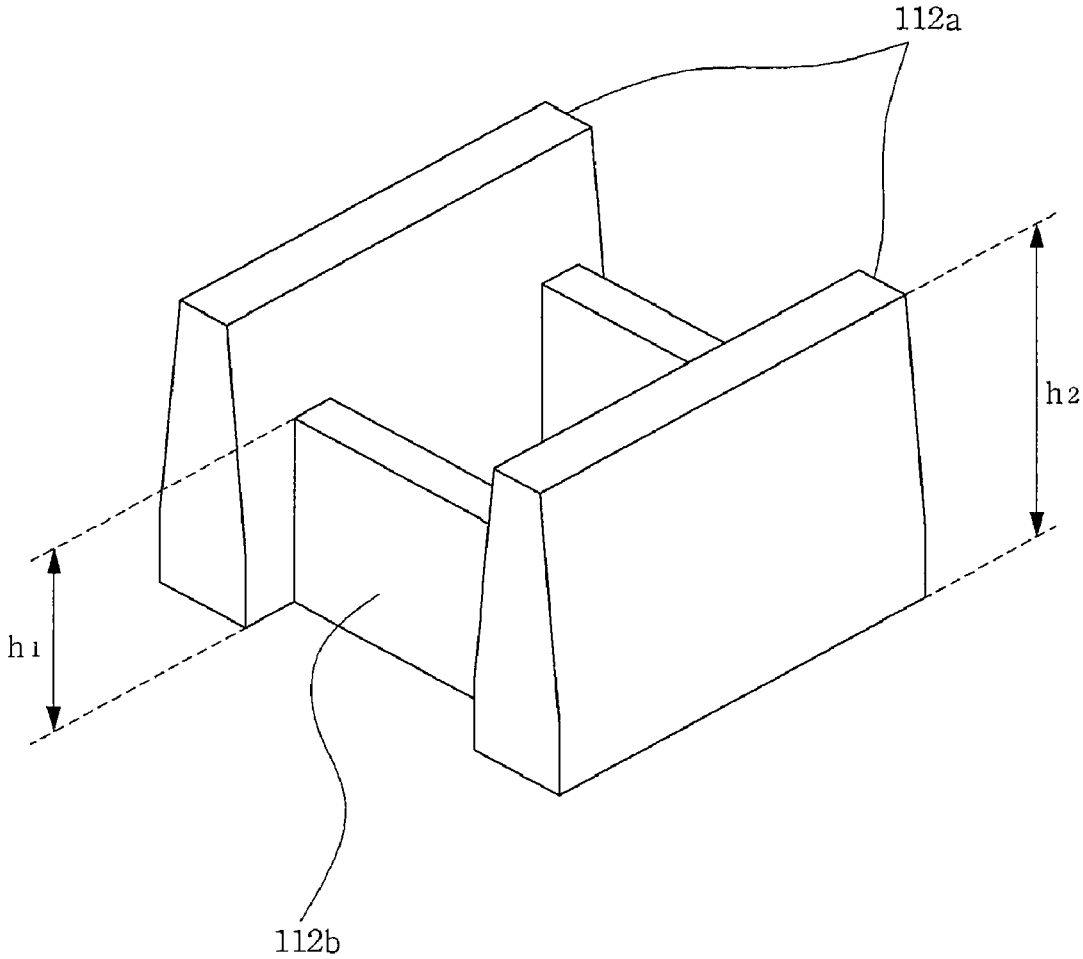
FIG. 3*a* and FIG. 3*b* illustrate a structure of barrier rib according to one embodiment.
Figure 3B:
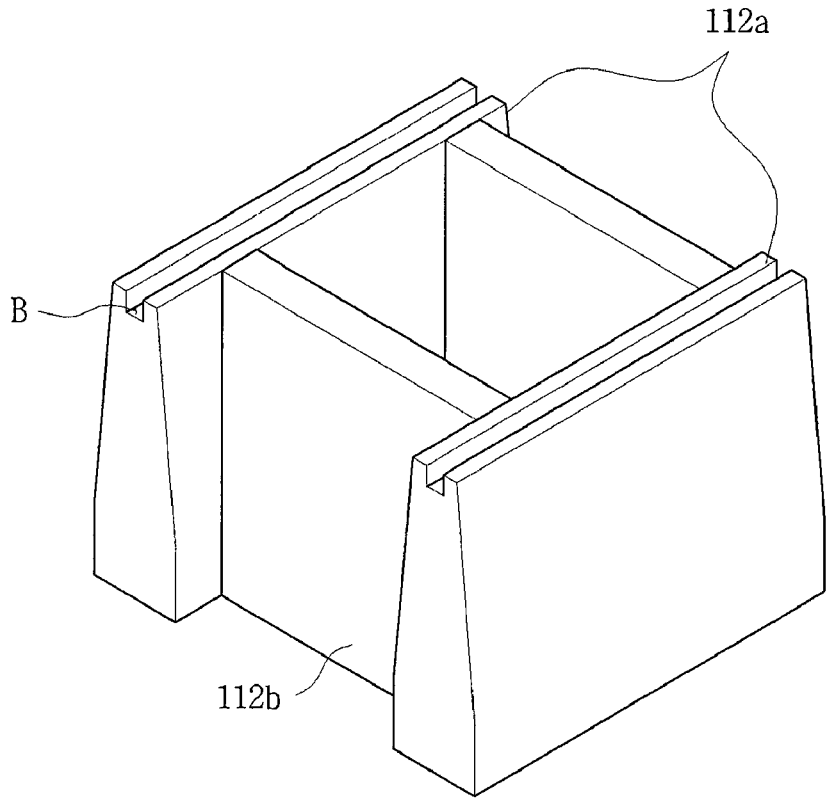

FIG. 3*a* and FIG. 3*b* illustrate a structure of barrier rib according to one embodiment.

Referring to FIG. 3*a*, the barrier rib 112 includes a first barrier rib 112*a* and a second barrier rib 112*b*. The height (h1) of the first barrier rib 112*a* and the height (h2) of the second barrier rib 112*b* are different from each other.

In this case, if a height of the first barrier rib 112*a* is more than a height of the second barrier rib 112*b*, the first barrier rib 112*a* partitions the discharge cells which contain a different phosphor therein and the second barrier rib 112*b* partitions the discharge cells which contain a same phosphor therein, respectively.

And thus, the structure of barrier rib improves a characteristic of exhaust of a plasma display panel when the plasma display panel is manufactured and prevents a color of phosphor in one discharge cell from being mixed by a phosphor in another discharge cell when the phosphor is formed into the discharge cell.

A difference of the height (h2) of the first barrier rib 112*a* and the height (h1) of the second barrier rib 112*b* ranges from 10 μm to 35 μm in the active area which is displayed an image.

And thus, when the plasma display panel has the barrier ribs 112*a*, 112*b* which have a different height each other in the critical value of the difference of the height between the barrier ribs 112*a*, 112*b*, the plasma display panel has a characteristic of exhaust improved as well as a strong property of barrier rib improved.

Referring to FIG. 3*b*, a groove (B) is formed in at least one of the upper portion of the first barrier rib 112*a* and the upper portion of the second barrier rib 112*b* in direction of the length of barrier rib.

As a result, a structure of the barrier rib improves a characteristic of exhaust of the plasma display panel.

Although the barrier rib 112 is formed over the rear substrate 111 in the embodiment of the invention, the barrier rib 112 may be formed over the front substrate 101 of the plasma display panel.

Figure 4:
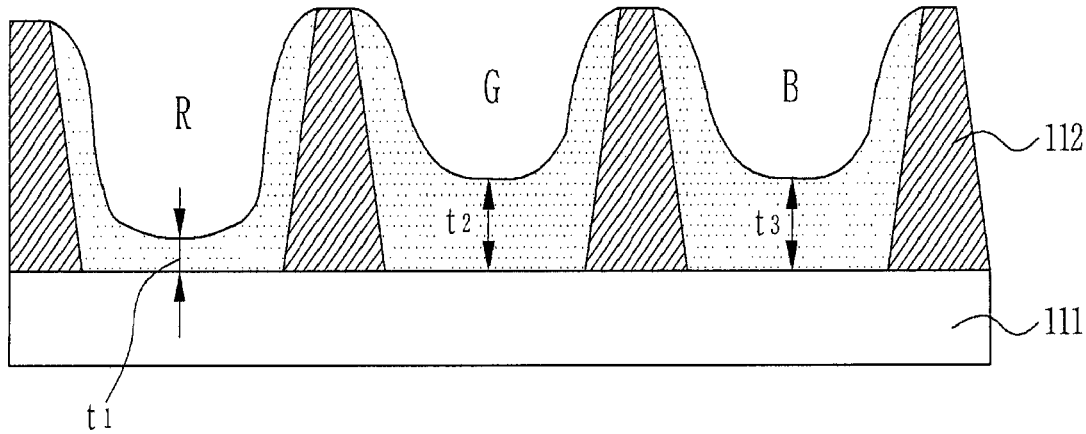
FIG. 4 illustrates the thickness of a phosphor layer formed inside the discharge cell of a plasma display panel according to one embodiment.

FIG. 4 illustrates a phosphor layer formed inside the discharge cell of a plasma display panel according to one embodiment.

Referring to FIG. 4, at least one of the thickness of the red phosphor layer (R), the thickness of green phosphor layer (G) and the thickness of blue phosphor layer (B) is different from one of the remaining phosphor layer.

In this case, the thickness (t1) of the red phosphor layer may be less than each thickness (t2, t3) of the green phosphor layer and the blue phosphor layer.

At least one of a thickness (t3) of the blue phosphor layer and a thickness (t2) of the green phosphor layer which is more than a thickness (t1) of the red phosphor layer ranges from 2 μm to 3 μm.

And thus, when the plasma display panel is manufactured in critical thickness of the phosphor layer, the plasma display panel increases an efficiency of a luminescent as well as a characteristic of color temperature of the phosphor.

Furthermore, the thickness (t2) of the green phosphor may be substantially equal to or may be different from the thickness (t3) of the blue phosphor.

It must be noted that only one example of the plasma display panel according to one embodiment has been illustrated and described above, and the embodiment is not limited to the plasma display panel of the above-described structure. For instance, although the above description illustrates a case where the upper dielectric layer 104 and the lower dielectric layer 115 each are formed in the form of a single layer, at least one of the upper dielectric layer 104 and the lower dielectric layer 115 may be formed in the form of a plurality of layers.

A black layer (not shown) for absorbing external light may be further formed on the upper portion of the barrier ribs 112 to prevent the reflection of the external light caused by the barrier ribs 112.

Further, a black layer (not shown) may be further formed at a predetermined position on the front substrate 201 corresponding to the barrier ribs 112.

The third electrode 113 formed on the rear substrate 211 may have a substantially constant width or thickness. Further, the width or thickness of the third electrode 113 inside the discharge cell may be different from the width or thickness of the third electrode 113 outside the discharge cell. For instance, the width or thickness of the third electrode 113 inside the discharge cell may be more than the width or thickness of the third electrode 113 outside the discharge cell.

In this way, the structure of the plasma display panel of the plasma display apparatus according to one embodiment may be changed in various ways.

Figure 5A:
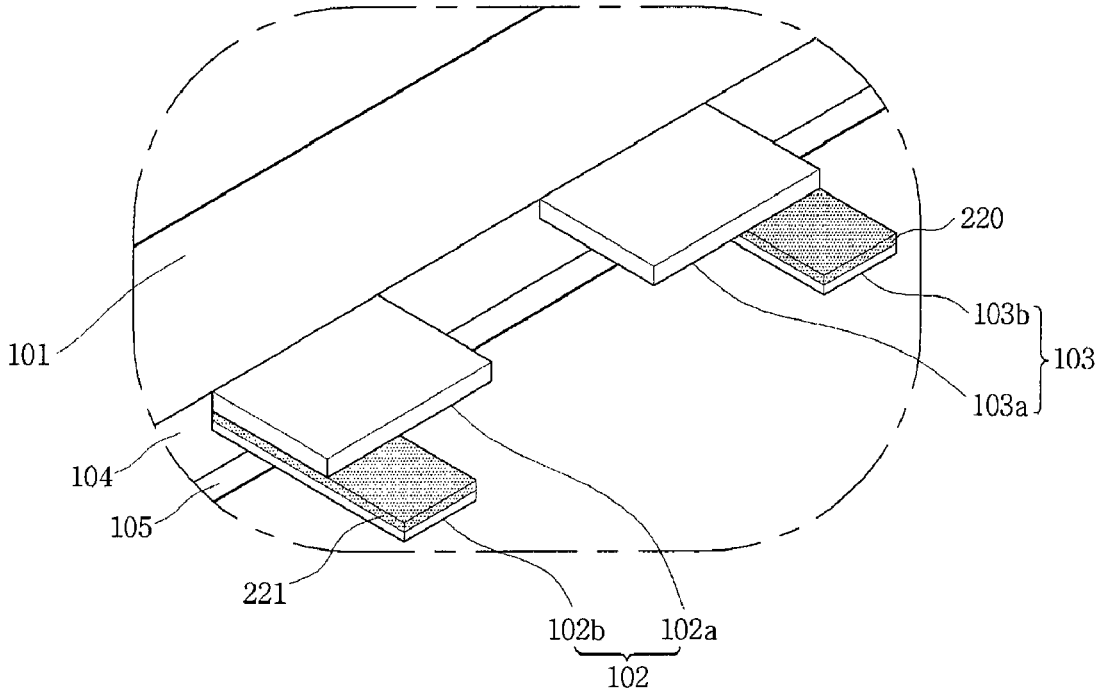
FIG. 5*a* and FIG. 5*b* illustrate a structure of electrode of a plasma display panel according to one embodiment.
Figure 5B:
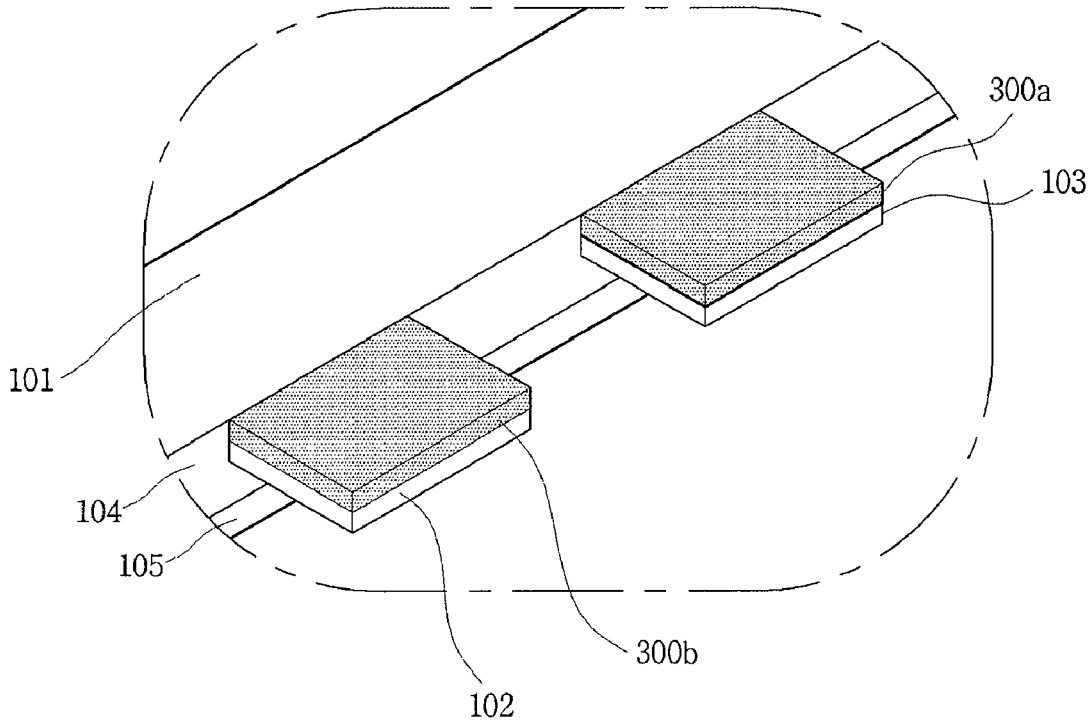

FIGS. 5*a* and 5*b* illustrate a structure of electrode of a plasma display panel according to one embodiment.

Referring to FIG. 5*a*, each of the first electrode 102 and the second electrode 103 includes a plurality of electrodes.

For instance, each of the first electrode 102 and the second electrode 103 includes bus electrodes 102*b* and 103*b* and transparent electrodes 102*a*. To emit light generated inside the discharge cells to the outside and secure the driving efficiency, the bus electrodes 102*b* and 103*b* include a material with high electrical conductivity such as silver (Ag), and the transparent electrodes 102*a* and 103*a* include a transparent material such as indium-tin-oxide (ITO).

When each of the first electrode 102 and the second electrode 103 includes the bus electrodes 102*b* and 103*b* and the transparent electrodes 102*a* and 103*a*, each of black layers 220 and 221 may be further formed between the bus electrode 102*b* and 103*b* and the transparent electrode 102*a* and 103*a* to prevent the reflection of external light caused by the bus electrodes 102*b* and 103*b*.

Referring to FIG. 5*b*, each of the first electrode 102 and the second electrode 103 consists of one electrode.

Each of the first electrode 102 and the second electrode 103 may contain an opaque and conductive materials such as silver (Ag), copper (Cu), aluminum (Al) or contain an transparent materials such as indium tin oxide (ITO).

And thus, it is easy to manufacture the first electrode 102 and the second electrode 103 such that the manufacturing cost is reduced.

The first electrode 102 and the second electrode 103 may be darker than a color of the upper dielectric layer 104.

Each of black layers 300*a*, 300*b* may be formed between the first electrode 102 and the front substrate 101 and between the second electrode 103 and the front substrate 101, respectively.

In this case, each of black layers 300*a*, 300*b* includes ruthenium (Ru) with dark color And thus, the black layers 300*a*, 300*b* prevent the first electrode 102 and the electrode 103 from changing a characteristic of the electrodes 102, 103.

(i.e., the changing of a characteristic of the electrode is defined as migration phenomenon of an electrode.)

Furthermore, the black layers 300*a*, 300*b* decrease a reflection ratio of a ray of light incident from outer space of the plasma display panel such that a characteristic of contrast is improved.

Figure 6:
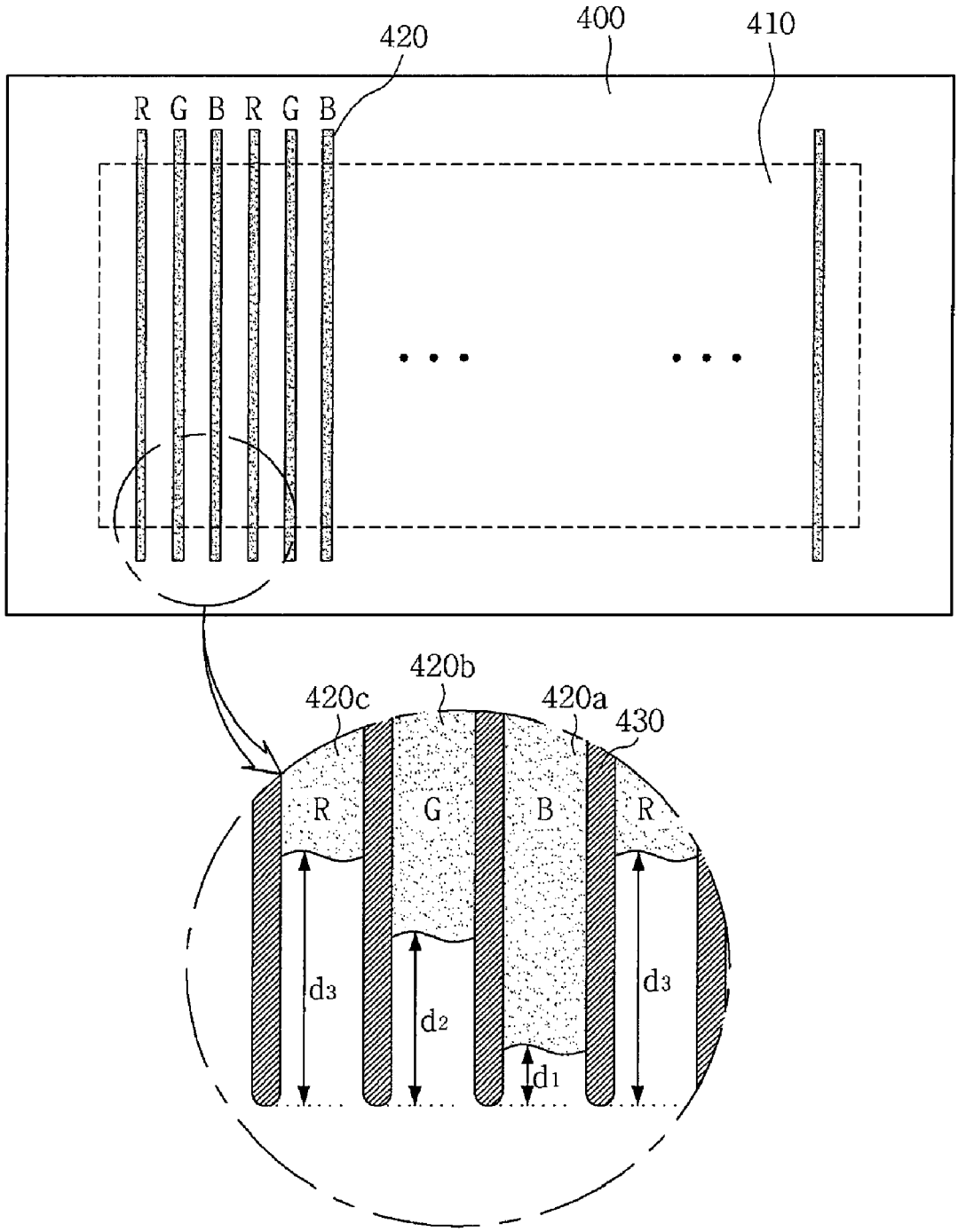
FIG. 6 illustrates the position of a phosphor layer in a plasma display panel according to one embodiment.

FIG. 6 illustrates a position of phosphor layer in a plasma display panel according to one embodiment.

Referring to FIG. 6, a substrate is divided into a dummy area 400 on which an image is not displayed and an active area 410 on which an image is displayed A phosphor layer 420 which is formed over the substrate includes a red phosphor layer, a green phosphor layer and a blue phosphor layer. In this case, at least one of a start point of the red phosphor layer, the green phosphor layer and the blue phosphor layer is different from a start point of the remaining phosphor layer.

The start point of the red phosphor layer, the green phosphor layer and the blue phosphor layer may be different from one another respectively.

The start point of the blue phosphor layer 420*a* may be prior to the start point of the red phosphor layer 420*c* and the start point of the green phosphor layer 420*b* from an edge of the substrate, or the start point of the green phosphor layer 420*b* may be prior to the start point of the red phosphor layer 420*c* from an edge of the substrate.

In this case, a position of the start point of the phosphor layers is positioned on the dummy area 400 of the substrate.

A distance between an edge of the barrier rib 430 and an edge of the blue phosphor layer 420*a* is defined as a first distance (d1) and a distance between an edge of the barrier rib 430 and an edge of the green phosphor layer 420*b* is defined as a second distance (d2) and a distance between an edge of the barrier rib 430 and an edge of the red phosphor layer 420*c* is defined as a third distance (d3).

In this case, the first distance (d1), the second distance (d2) and the third distance (d3) may be different from one another respectively.

Figure 7A:
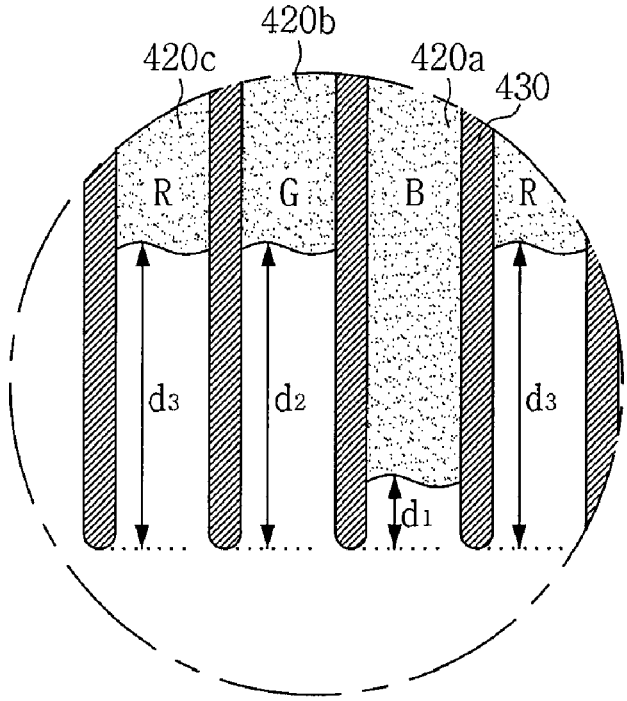
FIG. 7*a* and FIG. 7*b* illustrate the position of a phosphor layer in a plasma display panel according to another embodiment.

Furthermore, as described in FIG. 7*a*, the first distance (d1) may be less than the second distance (d2) and the third distance (d3). In this case, the second distance (d2) and the third distance (d3) may be substantially equal to each other.

Figure 7B:
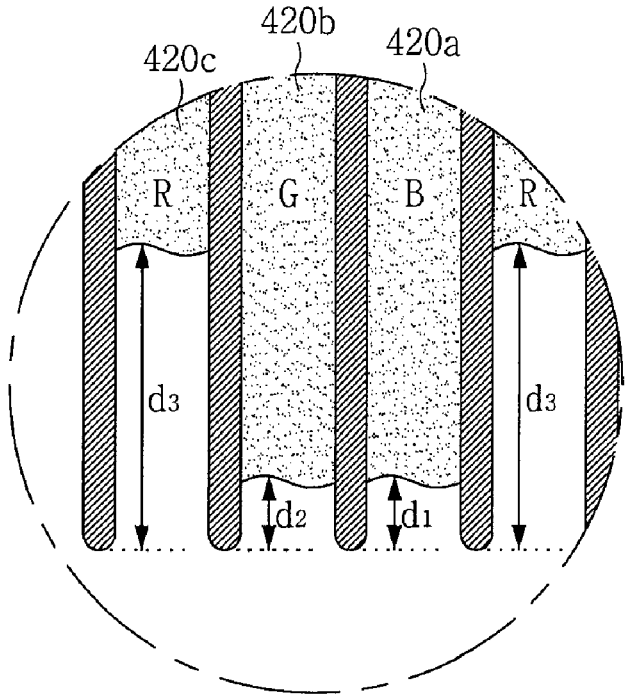

As described in FIG. 7*b*, the first distance (d1) and the second distance (d2) may be less than the third distance (d3). In this case, the first distance (d1) and the second distance (d2) may be substantially equal to each other.

Figure 8:
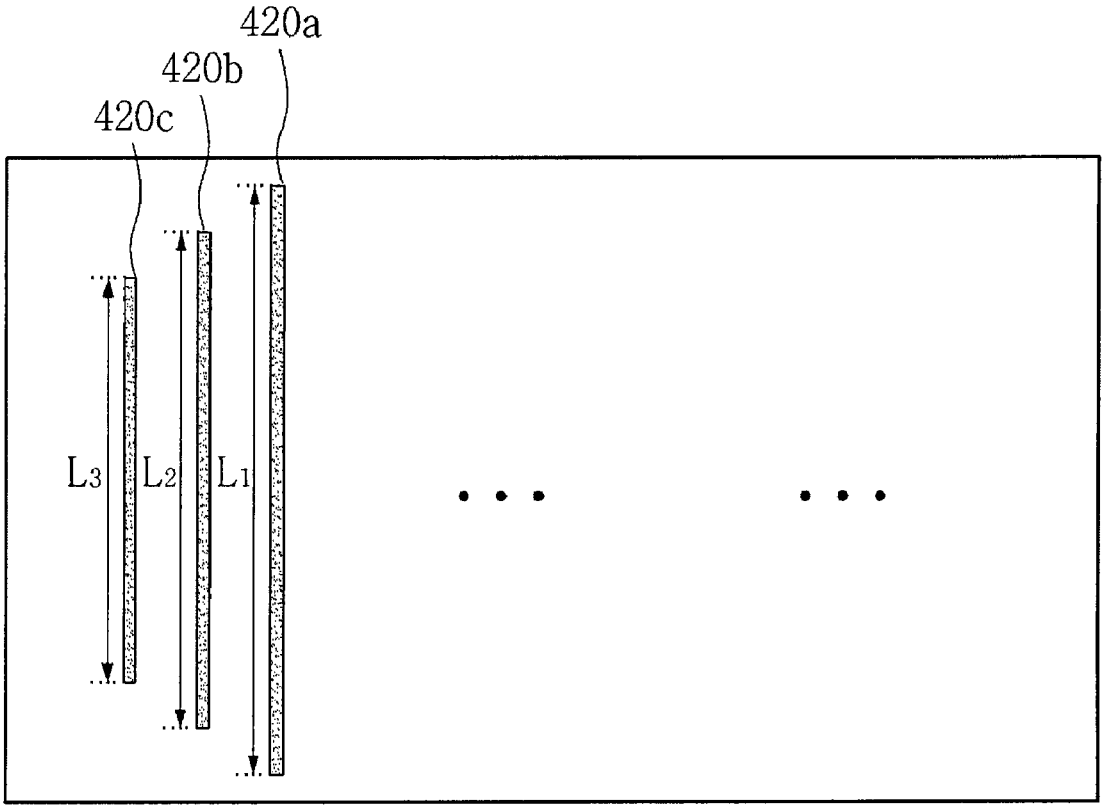
FIG. 8 illustrates the length of a phosphor layer according to one embodiment.

FIG. 8 illustrates the length of a phosphor layer according to one embodiment.

At least one of a length (L1) of a blue phosphor layer 420*a*, a length (L2) of a green phosphor layer 420*b* and, a length (L3) of red phosphor layer 420*c* may be different from the length of the remaining phosphor layer on the substrate.

For example, as described in FIG. 8, the length (L1) of the blue phosphor layer 420*a* may be more than the length (L2) of the green phosphor layer 420*b* and the length (L3) of the red phosphor layer 420*c*. In this case, the length (L2) of the green phosphor layer 420*b* may be more than the length (L3) of the red phosphor layer 420*c*.

A difference among a blue phosphor layer, a green phosphor layer and a red phosphor layer may be applied to the phosphor layers which are formed in a dummy area of the substrate.

Meanwhile, a dielectric layer (not shown) which is formed on the substrate may include a first portion of the dielectric layer, a second portion of the dielectric layer and a third portion of the dielectric layer.

The first portion of the dielectric layer, the second portion of the dielectric layer and the third portion of the dielectric layer is corresponded to the red phosphor layer, the green phosphor layer and the blue phosphor layer, respectively. And each the first portion of the dielectric layer, the second portion of the dielectric layer and the third portion of the dielectric layer is an area where the phosphor is not formed thereon.

In this case, at least one of a length of a first portion of the dielectric layer, a length of a second portion of the dielectric layer and a length of a third portion of the dielectric layer is different from a length of the remaining portion of the dielectric layer, FIGS. 9*a* to 9*d* illustrate a dispensing characteristic of a phosphor according to one embodiment.

Figure 9A:
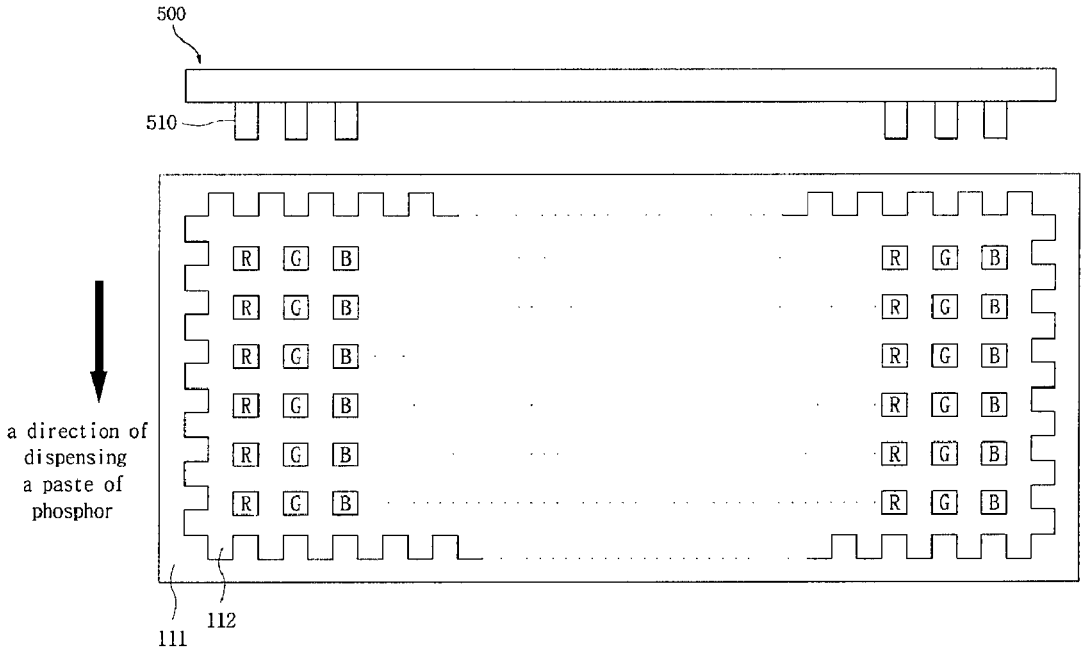
FIGS. 9*a* to 9*d* illustrate a dispensing characteristic of a phosphor according to one embodiment.

Referring to FIG. 9*a*, a phosphor layer is formed by using various methods. The one of the various methods is a 'Dispensing' which use a dispensing apparatus 500.

The dispensing apparatus 500 dispenses the material (i.e., a paste or a slurry) of a phosphor through a nozzle 510 into discharge cells which is partitioned by barrier rib 112.

After that, the paste of the phosphor is dried and plasticized. As a result, the phosphor layer is formed.

Meanwhile, when the material of a phosphor is dispensed into the discharge cells, the difference between circumstances (i.e., temperature) of inner space of the nozzle 510 and circumstances of outer space of the nozzle 510 cause a material of the phosphor to be dispensed into the discharge cells non-uniformly at the beginning period of dispensing.

Figure 9B:
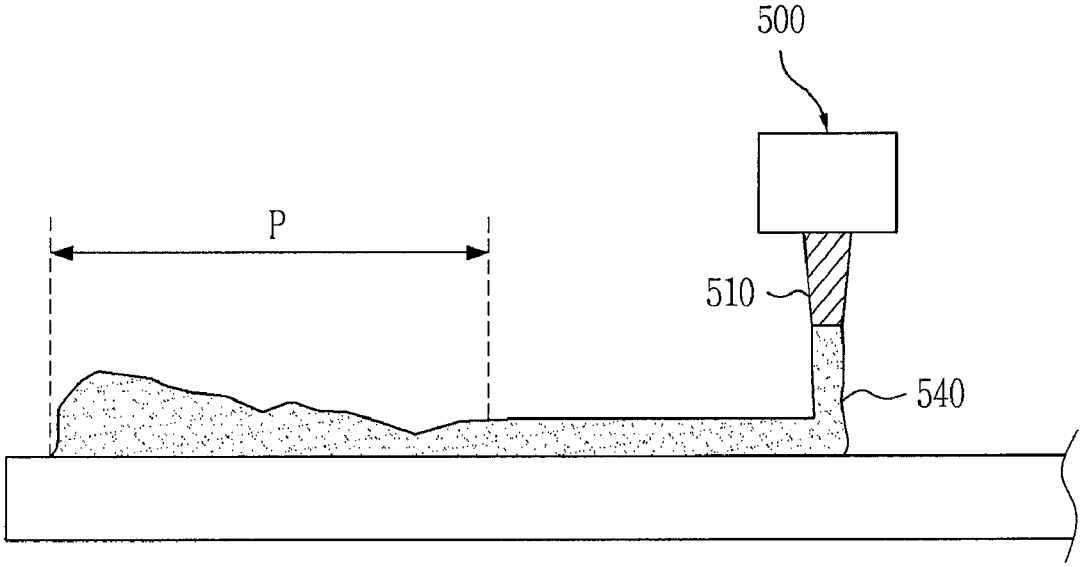
Figure 9C:
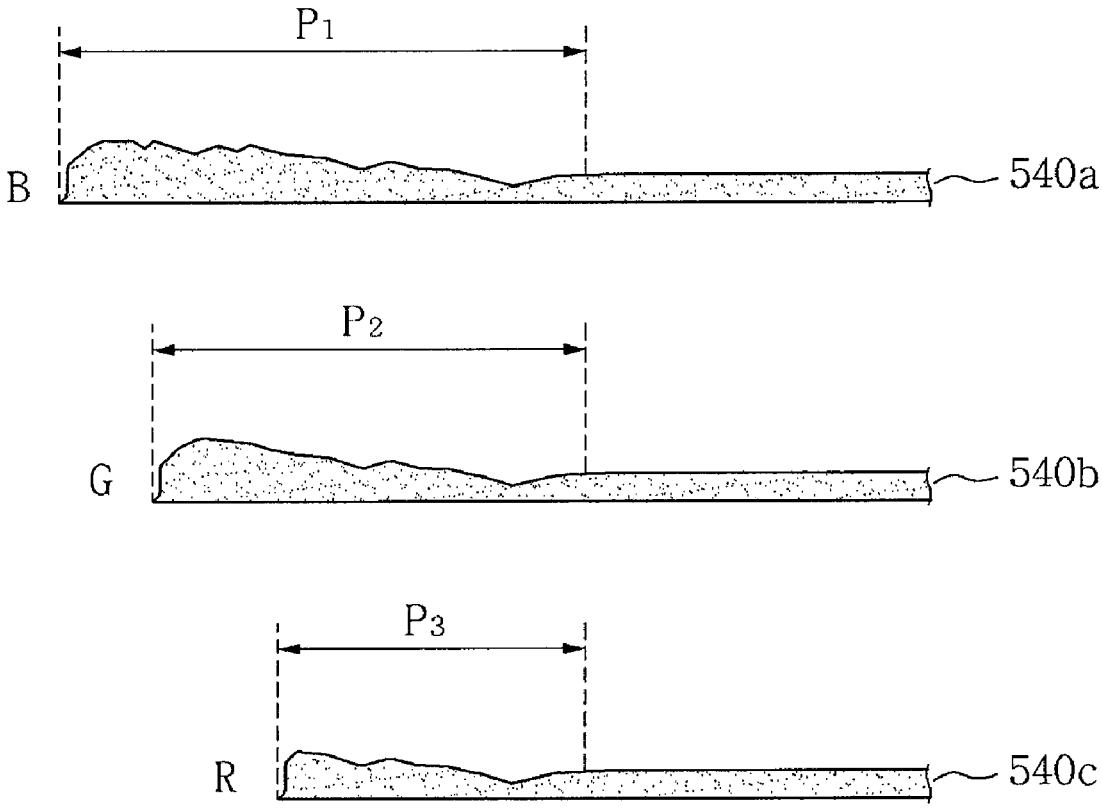

Therefore, as described in FIG. 9*b*, the phosphor does not formed uniformly on the substrate in the "P" period which is showed in the beginning period of the dispensing.

The duration of the beginning period of dispensing the material of phosphors is different from one another according to a characteristic of the material of phosphors. That is, as described in FIG. 9*c*, the duration (P1) of the beginning period of dispensing the material of the blue phosphor may be longer than the duration (P2) of the beginning period of dispensing the material of the green phosphor or the duration (P3) of the beginning period of dispensing the material of the red phosphor.

Accordingly, it is necessary that the starting point of dispensing of the phosphors is controlled to dispense the material of phosphors uniformly on the same active area of the substrate. That is, the dispensing apparatus sets the start point of dispensing the blue phosphor layer to be prior to the start point of dispensing the green phosphor and dispensing the red phosphor from the edge of the barrier rib.

Figure 9D:
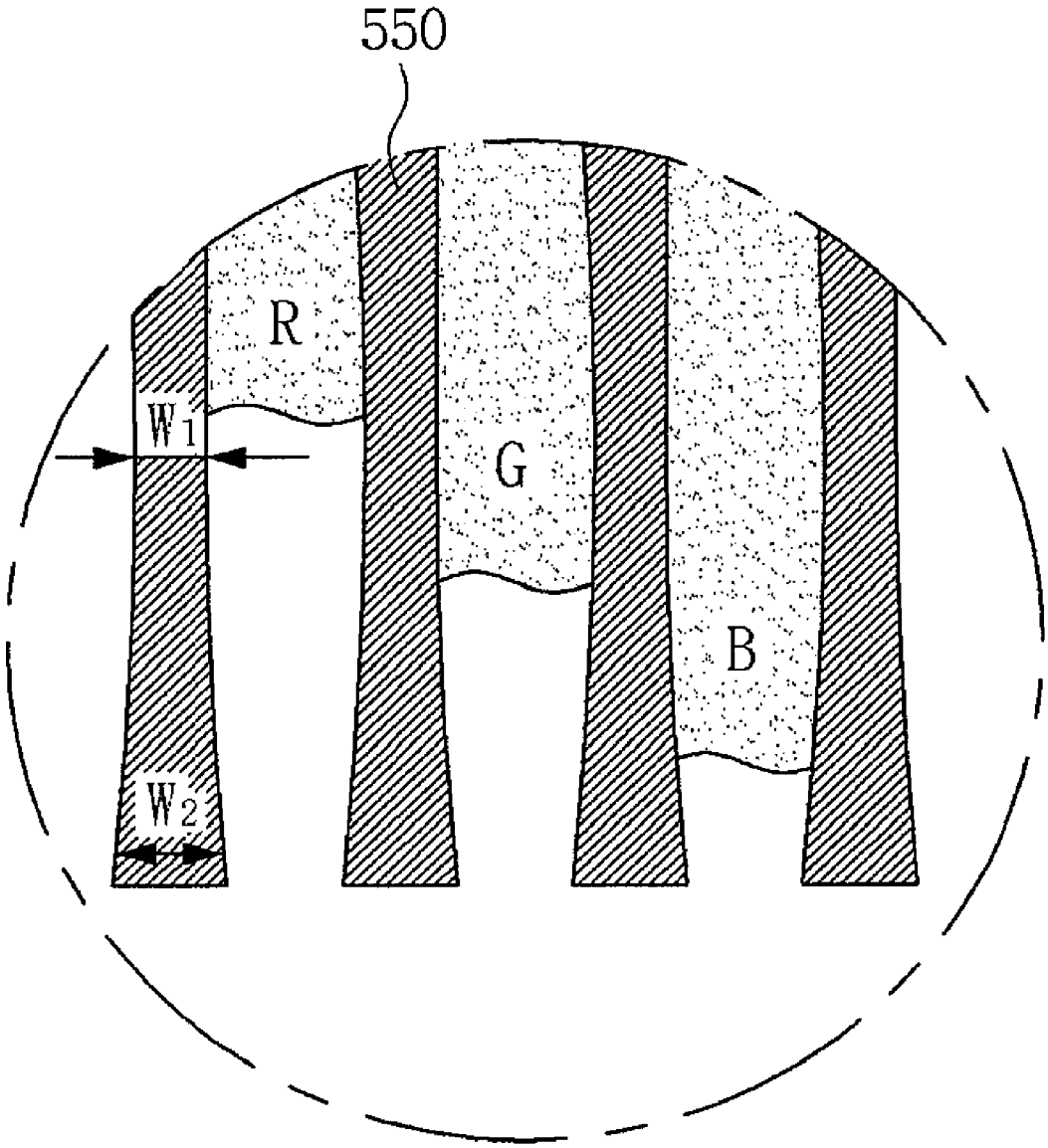

As described in FIG. 9*d*, the width (W2) of the side portion of the barrier rib 550 may be wider than the width (W1) of a remaining portion of the barrier rib so that the dispensing apparatus 500 carry out the stable dispensing.

Because a structure of the barrier rib 550 of the above allows the dispensing apparatus 500 to detect the barrier rib 550 easily at the side portion of the barrier rib so that the dispensing apparatus 500 may accurately control a starting point of dispensing the material of phosphors.

Furthermore, a structure of the barrier rib which is described in FIG. 9*d* increases the strength of the barrier rib.

Figure 10:
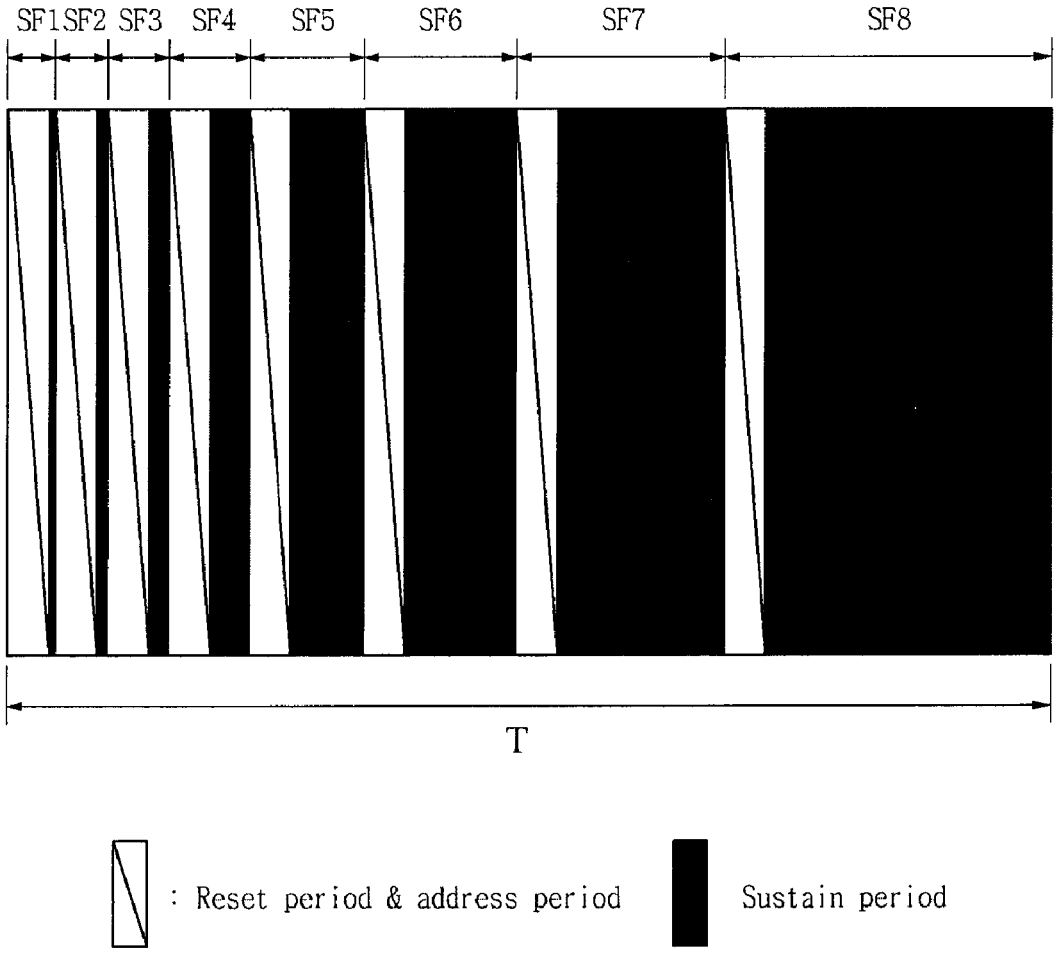
FIG. 10 illustrates a method for representing a gray level of an image in the plasma display panel according to one embodiment.

FIG. 10 illustrates a method for representing a gray level of an image in the plasma display panel according to one embodiment.

Referring to FIG. 10, in the plasma display panel according to one embodiment, a frame is divided into several subfields having a different number of emission times.

Each subfield is subdivided into a reset period for initializing all the discharge cells, an address period for selecting cells to be discharged, and a sustain period for representing gray level in accordance with the number of discharges.

The number of subfields constituting one frame may vary with a gray level to be represented.

For example, if an image with 256-level gray level is to be displayed, the frame is divided into 8 subfields SF1 to SF8. The number of sustain signals supplied during a sustain period of each subfield determines gray level weight in each subfield.

For example, in such a method of setting gray level weight of a first subfield to $2^0$ and setting gray level weight of a second subfield to $2^1$, the sustain period increases in a ratio of $2^n$ (where, n=0, 1, 2, 3, 4, 5, 6, 7) in each of the subfields. Since the sustain period varies from one subfield to the next subfield, a specific gray level is achieved by controlling the sustain period which are to be used for discharging each of the selected cells, i.e., the number of sustain discharges that are realized in each of the discharge cells.

Although FIG. 10 has illustrated and described the subfields arranged in increasing order of gray level weight, the subfields may be arranged in decreasing order of gray level weight, or the subfields may be arranged regardless of gray level weight.

Figure 11:
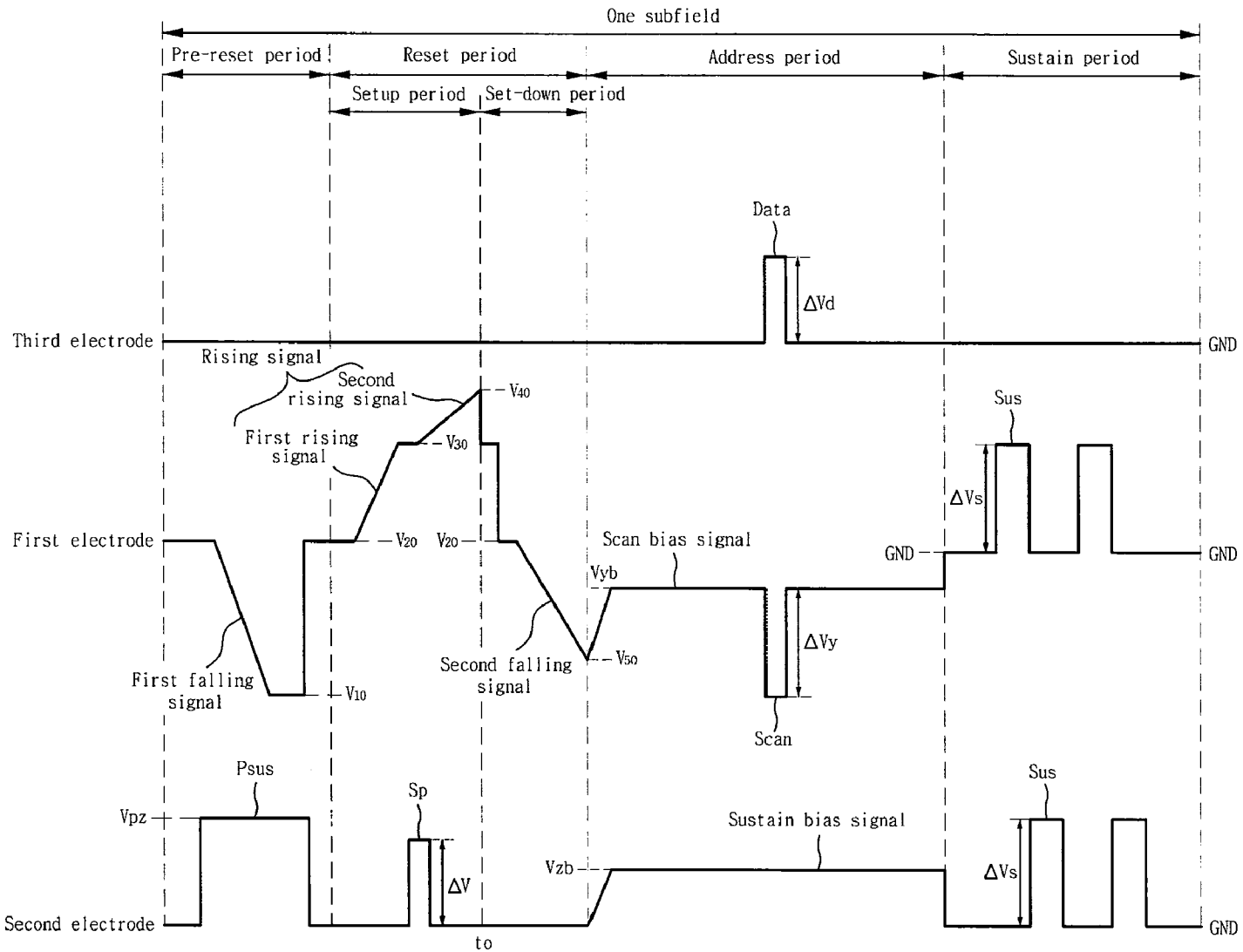
FIG. 11 illustrates a driving waveform supplied during one subfield when driving the plasma display panel according to one embodiment.

FIG. 11 illustrates a driving waveform supplied during one subfield when driving the plasma display panel according to one embodiment.

Referring to FIG. 11, during a pre-reset period prior to a reset period, a first falling signal is supplied to a first electrode Y. During the supplying of the first falling signal to the first electrode Y, a pre-sustain signal (Psus) of a polarity opposite a polarity of the first falling signal is supplied to a second electrode Z.

The first falling signal supplied to the first electrode Y gradually falls to a first voltage V10.

A voltage Vpz of the pre-sustain signal (Psus) is substantially equal to a voltage Vs of a sustain signal (Sus) which will be supplied during a sustain period.

As above described, the first falling signal is supplied to the first electrode Y and the pre-sustain signal is supplied to the second electrode Z during the pre-reset period such that wall charges of a predetermined polarity are accumulated on the first electrode Y and wall charges of a polarity opposite the polarity of the wall charges accumulated on the first electrode Y are accumulated on the second electrode Z. For example, wall charges of a positive polarity are accumulated on the first electrode Y, and wall charges of a negative polarity are accumulated on the second electrode Z.

As a result, the initialization of all the discharge cells formed in the plasma display panel is stably performed during the reset period which follows the pre-reset period.

Further, even if a rising signal having a relatively low voltage is supplied to the first electrode Y during the reset period, the initialization of all the discharge cells is stably performed.

A first subfield in a plurality of subfields of one frame may include a pre-reset period prior to a reset period. The first and second subfields or the first, second and third subfields in the plurality of subfields may include a pre-reset period prior to a reset period.

Each subfield may not include the pre-reset period.

During the reset period which follows the pre-reset period, a rising signal and a second falling signal are supplied to the first electrode Y and a positive polarity signal (Sp) is supplied to the second electrode Z.

The rising signal includes a first rising signal and a second rising signal. The first rising signal gradually rises from a second voltage V20 to a third voltage V30 with a first slope, and the second rising signal gradually rises from the third voltage V30 to a fourth voltage V40 with a second slope.

The second slope of the second rising signal is gentler than the first slope of the first rising signal. When the second slope is gentler than the first slope, the quantity of light generated by a setup discharge is reduced such that contrast of the plasma display apparatus is improved.

The positive polarity signal (Sp) is supplied to the second electrode Z during the supplying of the rising signal or before an end time point of the rising signal.

It may be that the width of the positive polarity signal (Sp) is smaller than the width of a sustain signal having the widest width in the plurality of sustain signals supplied to at least one of the first electrode or the second electrode during the sustain period.

A magnitude (ΔV) of a voltage of the positive polarity signal (Sp) is substantially equal to a magnitude (ΔVs) of the voltage of the sustain signal (Sus) supplied to at least one of the first electrode or the second electrode during the sustain period. During a setup period of the reset period, the rising signal generates a weak setup discharge inside the discharge cells, thereby accumulating a predetermined amount of wall charges inside the discharge cells.

The positive polarity signal (Sp) reduces the amount of wall charges excessively accumulated inside the discharge cells, thereby reducing the generation of an erroneous discharge during the address period and the sustain period.

During a set-down period of the reset period, the second falling signal of a polarity opposite a polarity of the rising signal is supplied to the first electrode Y.

The second falling signal gradually falls from the second voltage V20 to a fifth voltage V50. The second falling signal generates a weak erase discharge (i.e., a set-down discharge) inside the discharge cells. Furthermore, the remaining wall charges are uniform inside the discharge cells to the extent that an address discharge can be stably performed.

During the address period, a scan bias signal, which gradually rises from the fifth voltage V50 to a voltage Vyb and then is maintained at the voltage Vyb, is supplied to the first electrode Y. A scan signal (Scan), which falls from the voltage Vyb of the scan bias signal by a scan voltage magnitude ΔVy, is supplied to all the first electrodes Y1 to Yn.

In this case, the width of the scan signal (Scan) may vary from one subfield to the next subfield. For example, the width of a scan signal in a subfield may be more than the width of a scan signal in the next subfield.

When the scan signal (Scan) is supplied to the first electrode Y, a data signal (Data) corresponding to the scan signal (Scan) is supplied to the third electrode X. The data signal (Data) rises from a ground level voltage GND by a data voltage magnitude ΔVd.

As the voltage difference between the scan signal (Scan) and the data signal (Data) is added to the wall voltage generated during the reset period, the address discharge occurs within the discharge cells to which the data signal (Data) is supplied.

A sustain bias signal is supplied to the second electrode Z during the address period to prevent the generation of the unstable address discharge.

The sustain bias signal is supplied to the second electrode Z after the passage of a predetermined duration of time from the supplying of the positive polarity signal (Sp). In this case, a duration of time ranging from an end time point of the supplying of the positive polarity signal (Sp) to a start time point of the supplying of the sustain bias signal is longer than the width of the positive polarity signal (Sp).

When the width of the positive polarity signal (Sp) is set to a, and the duration of time ranging from the end time point of the supplying of the positive polarity signal (Sp) to the start time point of the supplying of the sustain bias signal is set to b, a ratio (b/a) of "b" to "a" is more than 1 and is equal to or less than 10. In this case, stable discharges occur during the reset period and the address period.

A supply time point of the sustain bias signal may correspond to a supply time point of the scan bias signal. Although it is not illustrated in the attached drawings, the sustain bias signal may be supplied to the second electrode Z during the set-down period or near the beginning of the address period.

A voltage Vzb of the sustain bias signal is lower than the voltage of the sustain signal which will be supplied during the sustain period, and is higher than the ground level voltage GND. Further, the voltage Vzb of the sustain bias signal is lower than the positive polarity signal (Sp).

During the sustain period, a sustain signal (Sus) is alternately supplied to the first electrode Y and the second electrode Z.

As the wall voltage within the discharge cell selected by performing the address discharge is added to a sustain voltage Vs of the sustain signal (Sus), every time the sustain signal (Sus) is supplied, a sustain discharge, i.e., a display discharge occurs between the first electrode Y and the second electrode Z.

Figure 12A:
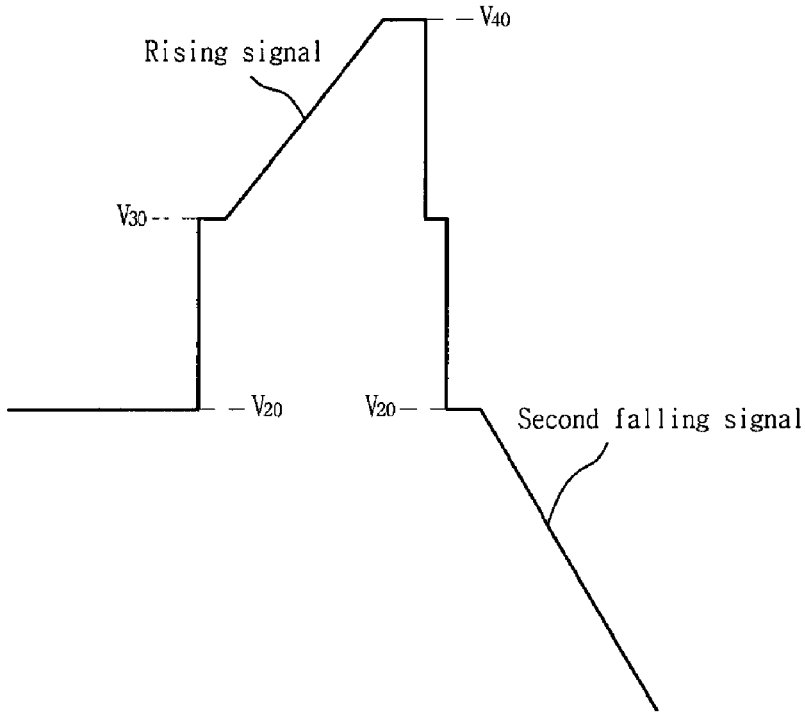
FIGS. 12*a* and 12*b* illustrate modifications of a rising signal and a second falling signal of FIG. 10.
Figure 12B:
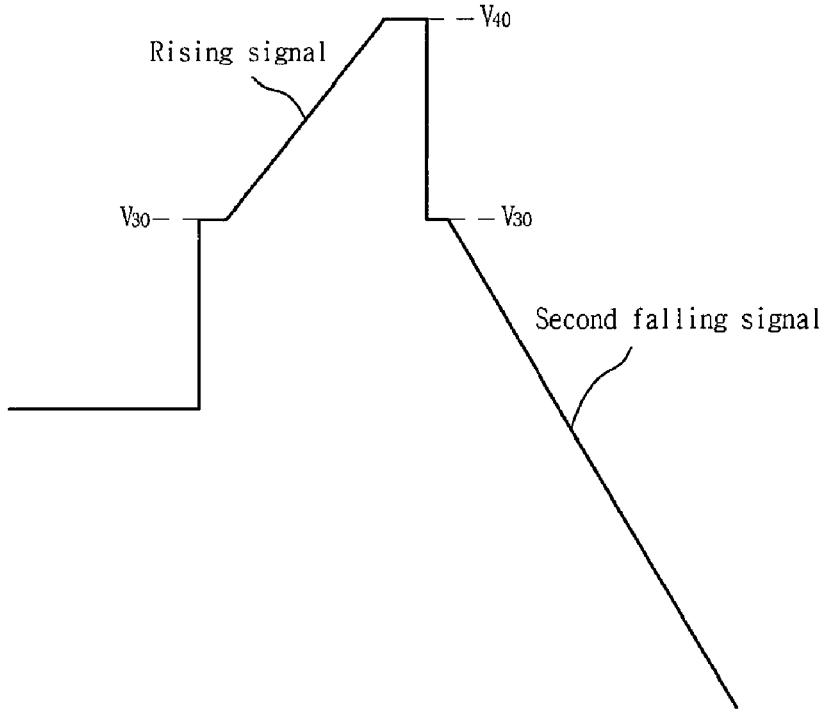

FIGS. 12*a* and 12*b* illustrate modifications of a rising signal and a second falling signal of FIG. 10.

Referring to FIG. 12*a*, the rising signal sharply rises to the third voltage V30, and then gradually rises from the third voltage V30 to the fourth voltage V40.

As above, the slope of the rising signal may vary.

Referring to FIG. 12*b*, the second falling signal gradually falls from the third voltage V30.

a voltage falling time point of the second falling signal is changeable.

Figure 13:
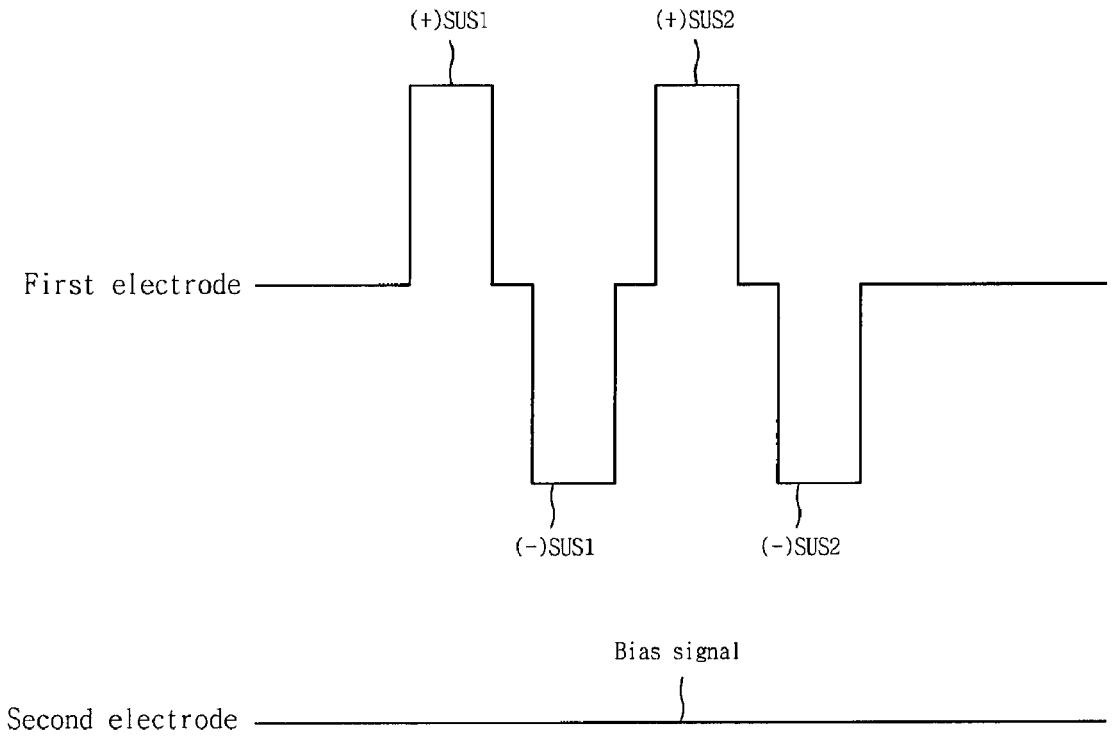
FIG. 13 illustrate a modification of a sustain signal of FIG. 10.

FIG. 13 illustrate a modification of a sustain signal of FIG. 10.

Referring to FIG. 13, when sustain signals (+SUS1 and +SUS2) of a positive polarity and sustain signals (−SUS1 and −SUS2) of a negative polarity are alternately supplied to the first electrode Y, a bias signal is supplied to the second electrode Z. On the contrary, during the supplying of a bias signal to the first electrode Y, a sustain signal of a positive polarity and a sustain signal of a negative polarity may be alternately supplied to the second electrode Z.

The bias signal is maintained at the ground level voltage GND.

when the sustain signal is supplied to either the first electrode Y or the second electrode Z, a single diving board for driving the first electrode Y and the second electrode Z during the sustain period may be installed.

Accordingly, the whole size of a driver for driving the plasma display panel is reduced such that the manufacturing cost is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel, comprising:

a substrate;

a plurality of barrier ribs having a same length and arranged abreast to dispose all of bottom edges thereof along a line; and a phosphor layer formed over the substrate and between the plurality of barrier ribs, wherein the phosphor layer includes a plurality of red phosphor layers having starting points separated from the line by a first distance, a plurality of green phosphor layers having starting points separated from the line by a second distance, and a plurality of blue phosphor layers having starting points separated from the line by a third distance, wherein one of the first distance, the second distance, or the third distance is different from an other one of the first distance, the second distance, or the third distance.

2. The plasma display panel of claim 1, wherein the first distance, the second distance, and the third distance are different from each other.

3. The plasma display panel of claim 1, wherein the second distance is shorter than the first distance.

4. The plasma display panel of claim 1, wherein the third distance is shorter than the first distance.

5. The plasma display panel of the claim 1, wherein at least one of a thickness of the blue phosphor layers and a thickness of the green phosphor layers is greater than a thickness of the red phosphor layers.

6. The plasma display panel of claim 1 wherein at least one of a thickness of the blue phosphor layers and a thickness of the green phosphor layers is greater than a thickness of the red phosphor layers and ranges from 2 μm to 3 μm.

7. The plasma display panel of claim 1, wherein a width of each said blue phosphor layer is greater than a width of each said red phosphor layer.

8. The plasma display panel of claim 1, wherein a width of each said green phosphor layer is greater than a width of each said red phosphor layer.

9. A plasma display panel, comprising:

a substrate divided into an active area and a dummy area by a boundary line;

a plurality of barrier ribs having a same length and arranged abreast to dispose all of bottom edges thereof along a line; and a phosphor layer formed over the substrate, wherein the phosphor layer includes a plurality of red phosphor layers having starting points extending from the boundary line into the dummy area by a first distance, a plurality of green phosphor layers having starting points extending from the boundary line into the dummy area by a second distance, and a plurality of blue phosphor layers having starting points extending from the boundary line into the dummy area by a third distance, wherein at least one of the second distance or the third distance is longer than the first distance.

10. The plasma display panel of claim 9, wherein a base width of an edge portion of each said barrier rib is greater than a base width of a remaining portion thereof.

11. The plasma display panel of claim 9, wherein a width of each said blue phosphor layer is greater than a width of each said red phosphor layer.

12. The plasma display panel of claim 9, wherein a width of each said green phosphor layer is greater than a width of each said red phosphor layer.

13. A plasma display panel, comprising:

a substrate;

a dielectric layer formed on the substrate;

a plurality of barrier ribs formed over the substrate, having a same length, and arranged abreast to dispose all of bottom edges thereof along a line; and a phosphor layer formed between the barrier ribs, wherein the phosphor layer includes a plurality of red phosphor layers having starting points separated from the line by a first length, a plurality of green phosphor layers having starting points separated from the line by a second length, and a plurality of blue phosphor layers having starting points separated from the line by a third length, wherein one of the first length, the second length, or the third length is different from an other one of the first length, the second length, or the third length.

14. The plasma display panel of claim 13, wherein the starting points of the plurality of red phosphor layers extend into the dummy area by a first distance, the starting points of the plurality of green phosphor layers extend into the dummy area by a second distance, the starting points of the plurality of blue phosphor layers extend into the dummy area by a third distance, and one of the first distance, the second distance, and the third distance is longer than an other one of the first distance, the second distance, and the third distance.

15. The plasma display panel of claim 13, wherein the dielectric layer includes a first portion a second portion, and a third portion which correspond to the red phosphor layers, the green phosphor layers and the blue phosphor layers, respectively, wherein each of the first portion, the second portion, and the third portion is an area where the phosphor layer is not formed, and one of a length of the first portion, a length of a the second portion, and a length of the third portion is different from an other one of the lengths of the first, second, and third portions.

16. The plasma display panel of the claim 13, wherein at least one of a thickness of the blue phosphor layers and a thickness of the green phosphor layers is greater than a thickness of the red phosphor layers.

17. The plasma display panel of claim 13, wherein at least one of a thickness of the blue phosphor layers and a thickness of the green phosphor layers is greater than a thickness of the red phosphor layers and ranges from 2 μm to 3 μm.

18. The plasma display panel of claim 13, wherein a width of each said blue phosphor layer is greater than a width of each said red phosphor layer.

19. The plasma display panel of claim 13, wherein a width of each said green phosphor layer is greater than a width of each said red phosphor layer.

20. The plasma display panel of claim 13, wherein a base width of an edge portion of each said barrier rib is greater than a base width of a remaining portion thereof.

* * * * *